US006601477B2

(12) United States Patent
Huang

(10) Patent No.: US 6,601,477 B2
(45) Date of Patent: Aug. 5, 2003

(54) WRENCH ADAPTOR ALLOWING REVERSIBLE OPERATION

(75) Inventor: Hsiu-Ching Huang, Taipei (TW)

(73) Assignee: Ander Chen, Chang Hua Hsien (TW)

( * ) Notice: Subject to any disclaimer, the term of this patent is extended or adjusted under 35 U.S.C. 154(b) by 0 days.

(21) Appl. No.: 10/073,649

(22) Filed: Feb. 11, 2002

(65) Prior Publication Data

US 2003/0121372 A1 Jul. 3, 2003

(30) Foreign Application Priority Data

Dec. 27, 2001 (TW) ..... 90223139 U

(51) Int. Cl.[7] ..... B25B 13/46

(52) U.S. Cl. ..... 81/62.3; 81/63.1; 81/62; 81/60

(58) Field of Search ..... 81/63.2, 63, 61, 81/121.1, 62, 60, 63.1

(56) References Cited

U.S. PATENT DOCUMENTS 4,932,293 A * 6/1990 Goff ..... 81/177.85
5,960,680 A * 10/1999 Chen et al. ..... 81/63.2
6,067,882 A * 5/2000 Hillinger ..... 81/63.1
6,109,140 A * 8/2000 Roberts et al. ..... 81/63
6,457,387 B1 * 10/2002 Hu ..... 81/63.2

* cited by examiner

*Primary Examiner*—Lee D. Wilson
(74) *Attorney, Agent, or Firm*—Alan D. Kamrath; Rider Bennett, LLP

(57) ABSTRACT

An adaptor comprises a housing, a body, a pawl, and a switch member. The housing includes an end for engaging with a socket. The body includes a first end to be engaged in a box end of a wrench and a second end received in a compartment defined in the other end of the housing. A pawl is pivotally mounted in a transverse groove in the body and includes two toothed sides. A switch member includes a first end for manual operation and a second end engaged with the pawl. The switch member is pivotable between two positions corresponding to two opposite ratcheting directions to selectively urge an associated one of the toothed sides of the pawl to engage with the toothed inner periphery of the housing.

7 Claims, 8 Drawing Sheets

3-3

5-5

WRENCH ADAPTOR ALLOWING REVERSIBLE OPERATION

BACKGROUND ON THE INVENTION

1. Field of the Invention

The present invention relates to a wrench adaptor allowing reversible operation. In particular, the present invention relates to a wrench adaptor that can be mounted to a box end of a wrench so as to engage with a socket while allowing reversible operation of the wrench.

2. Description of the Related Art

FIG. 7 of the drawings illustrates a conventional socket wrench 1*a* including a handle 11*a* and a head 12*a* having a compartment 121*a*. An annular groove 1211*a* is defined in an inner periphery defining the compartment 121*a* for receiving a C-clip 3*a*. The C-clip 3*a* includes plural protrusions 31*a* on an inner periphery thereof for engaging with an outer periphery 21*a* of a socket 2*a* received in the compartment 121*a* of the head 12*a*. The socket 2*a* is thus directly held in the head 12*a*. However, the wrench 1*a* can only be used with sockets 2*a* having a hexagonal outer periphery 21*a*. Namely, the wrench 1*a* cannot be used with sockets having a circular outer periphery. In addition, when using the sockets 2*a* with a conventional ring spanner, the latter can be used for driving a fastener in a single direction; namely, reversible operation cannot be obtained.

FIG. 8 illustrates a conventional combination wrench 3*b* having a box end. An adaptor 1*b* is coupled with the box end so as to engage with a socket 2*b*. The adaptor 1*b* includes a pawl section 17*b* that is configured complimentary to corners 32*b* of an inner periphery defining a hole 31*b* of the box end. The adaptor 1*b* further includes a flange 12*b* and a positioning member 18*b* respectively abutting against an upper edge and a bottom edge of the box end, thereby retaining the box end in place. A switch member 141*b* is provided on top of the adaptor 1*b* to allow switching in the ratcheting direction. However, the adaptor 1*b* can only be used with combination wrenches of special types having specific corners 32*b*. In a case that the comers 32*b* of the box end of the wrench are not configured complimentary to the pawl section 17*b*, the latter would slide easily relative to the former. In addition, switching by means of turning the switch member 141*b* cannot be easily achieved with a single hand. Further, the positioning member 18*b* could not provide a sufficient retaining force for retaining the adaptor in place.

SUMMARY OF THE INVENTION

An object of the present invention is to provide a wrench adaptor that can be mounted to a box end of a wrench so as to engage with a socket while allowing reversible operation of the wrench.

In accordance with the present invention, an adaptor is provided for engaging with a box end of a wrench for use with a socket. The adaptor comprises a housing, a body, a pawl, a biasing means, and a switch member. The housing includes a first end and a second end for engaging with a socket. The first end of the housing includes a compartment defined by a toothed inner periphery. The body includes a first end to be engaged in a box end of a wrench and a second end rotatably received in the compartment of the housing. The body includes a transverse groove, a bottom wall defining the transverse groove including a cavity. A pawl is pivotally mounted in the transverse groove and includes a first toothed side and a second toothed side selectively engaged with the toothed inner periphery of the housing. The biasing means is mounted in the cavity of the body for biasing the pawl toward the toothed inner periphery of the housing, thereby allowing one of the first toothed side and the second toothed side of the pawl to engage with the toothed inner periphery of the housing. A switch member includes a first end for manual operation and a second end engaged with the pawl. The switch member is pivotable between two positions corresponding to two opposite ratcheting directions to selectively urge an associated one of the first toothed side and the second toothed side of the pawl to engage with the toothed inner periphery of the housing.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
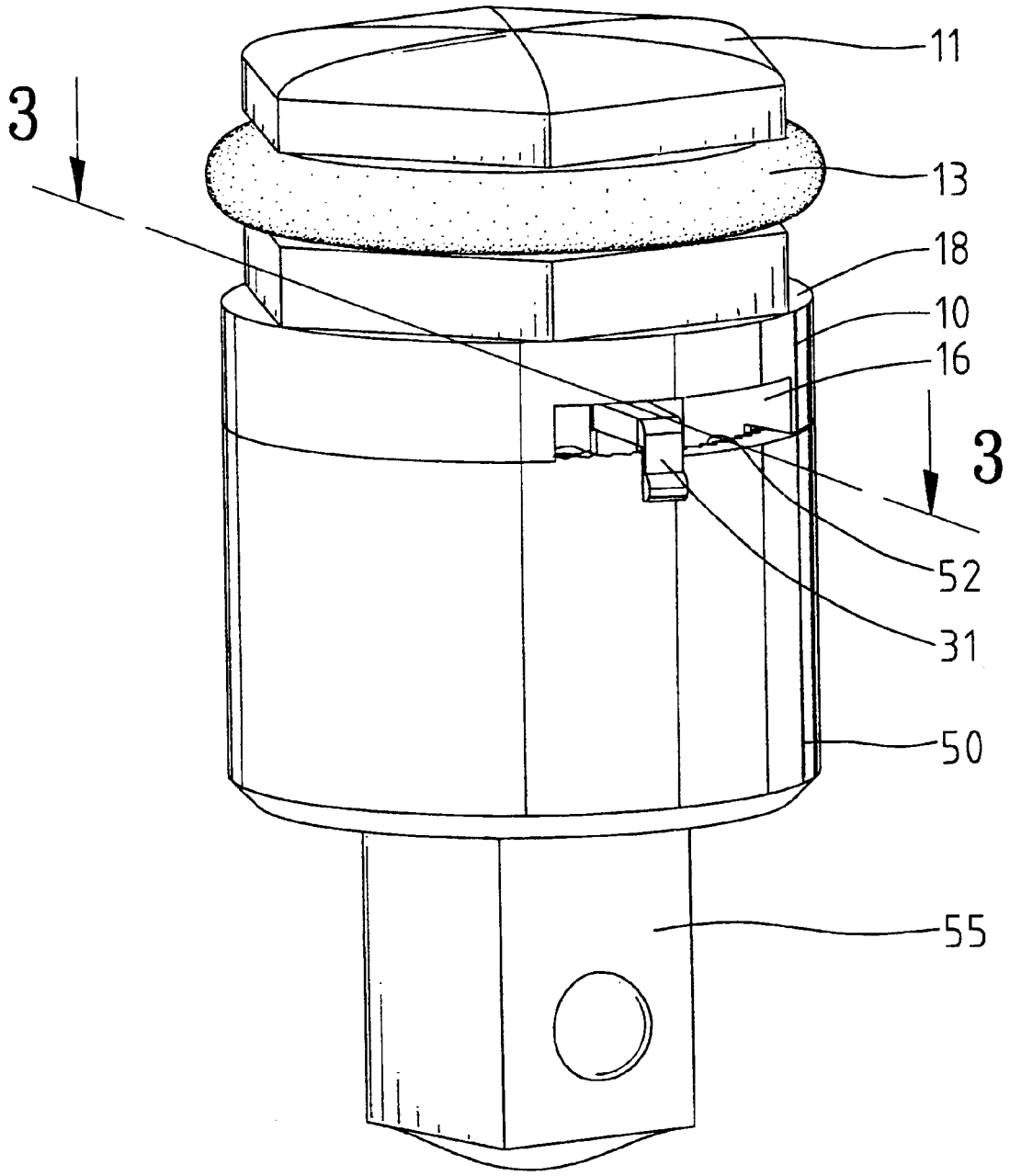
FIG. 1 is a perspective view of an adaptor in accordance with the present invention.
Figure 2:
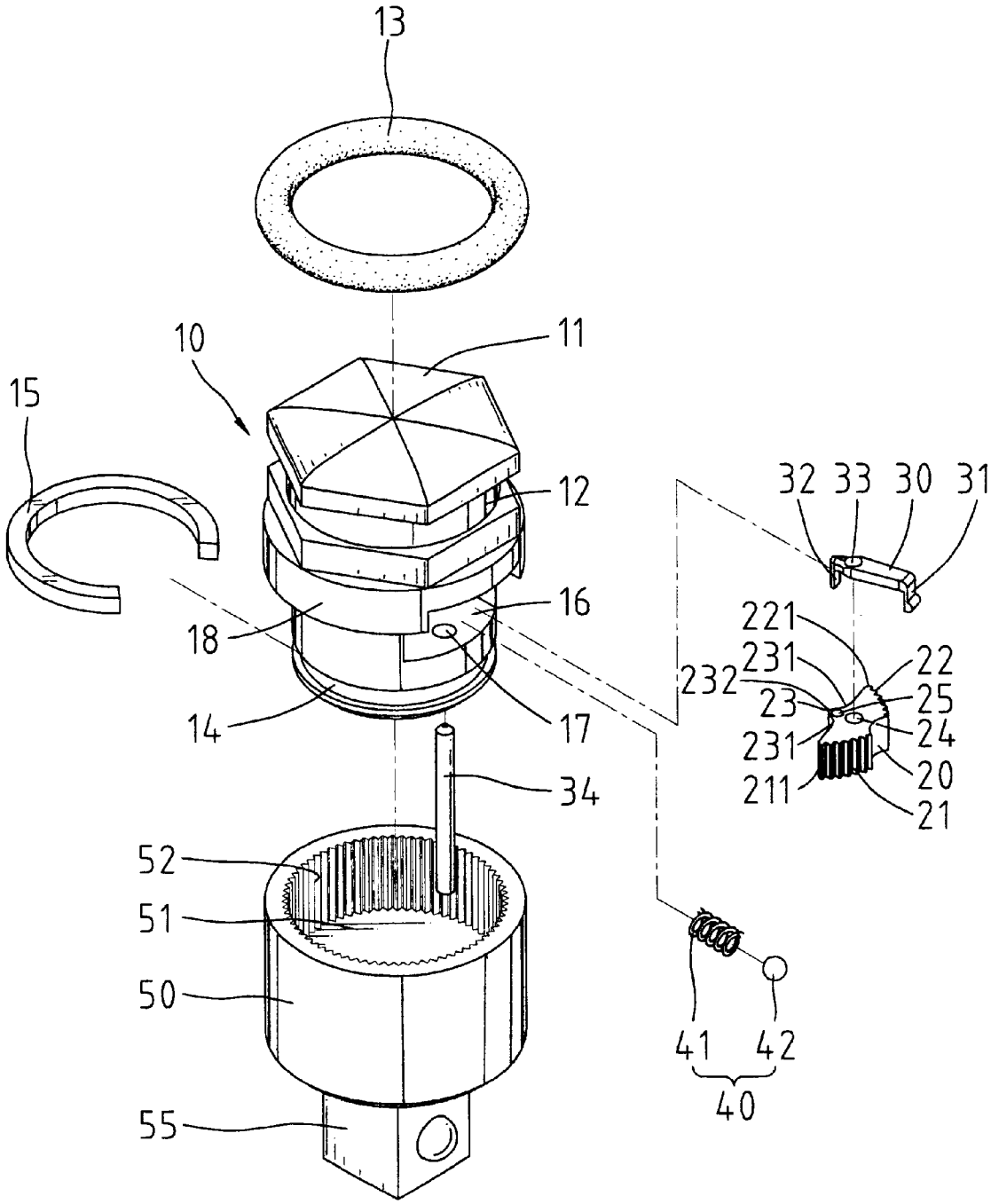
FIG. 2 is an exploded perspective view of the adaptor in accordance with the present invention.
Figure 3:
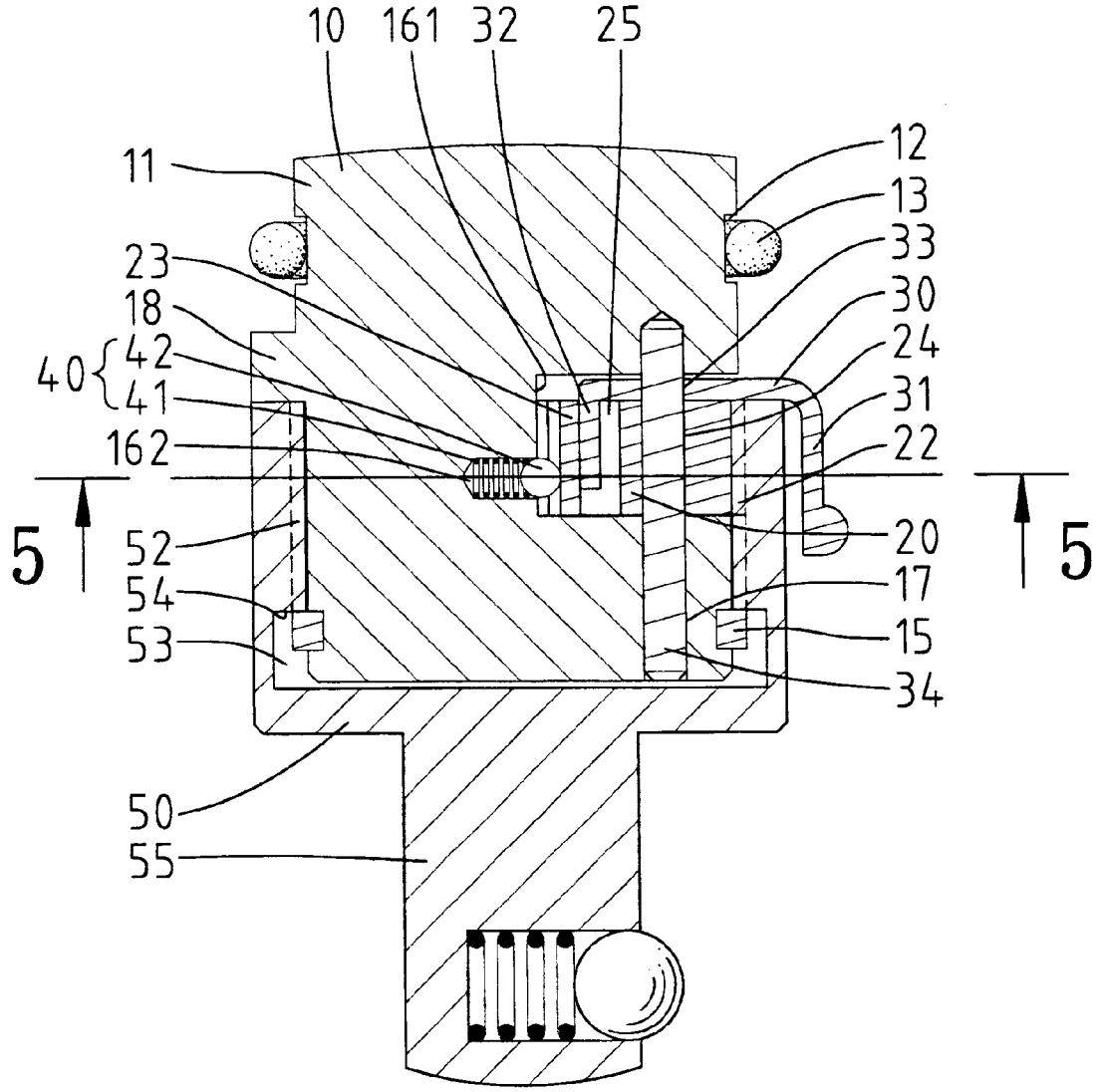
FIG. 3 is a sectional view taken along plane 3—3 in FIG. 1.
Figure 4:
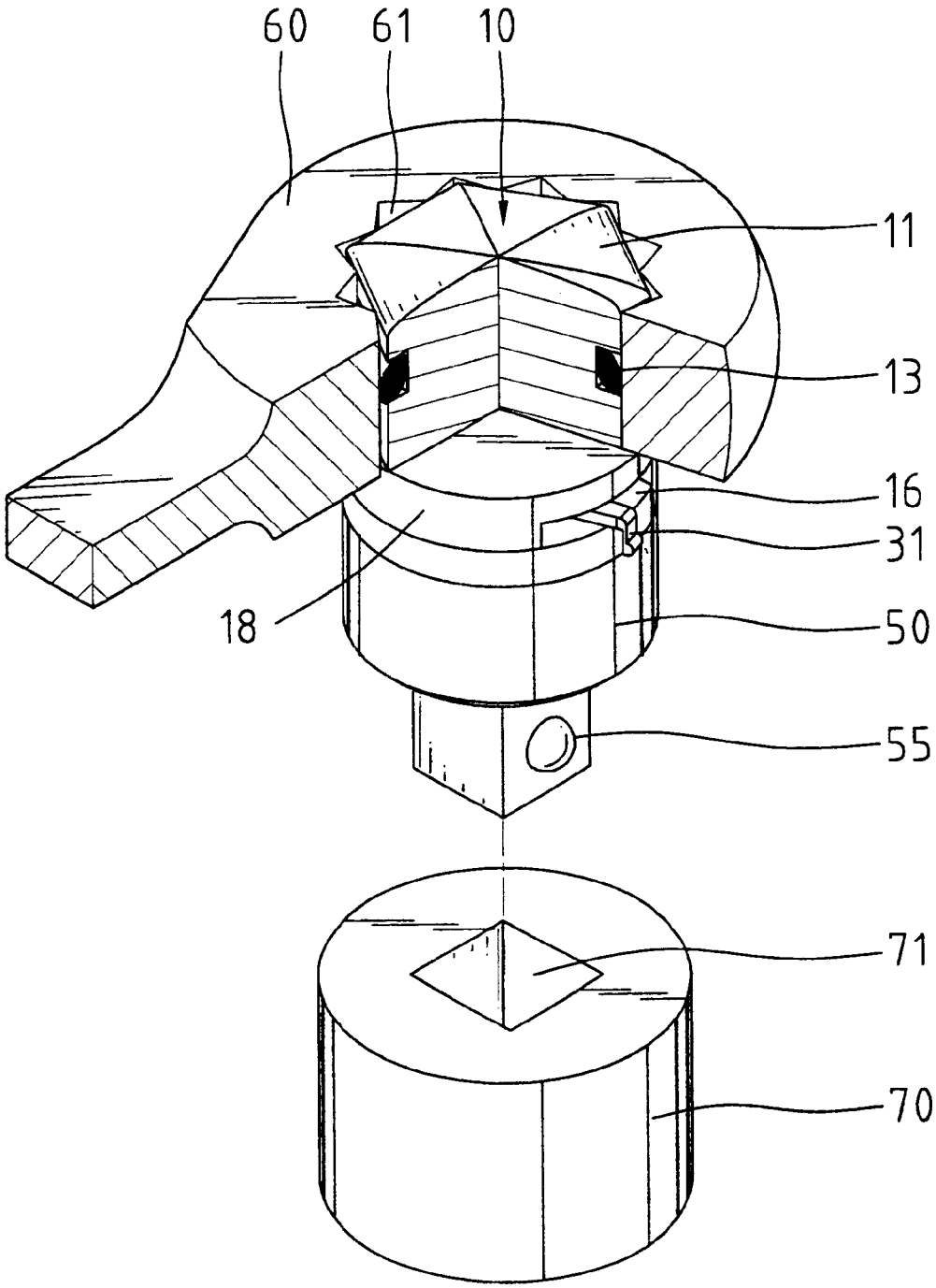
FIG. 4 is a perspective view, partly cutaway, illustrating use of the adaptor in accordance with the present invention with a wrench and a socket.

Referring to FIG. 4, an adaptor in accordance with the present invention is to be mounted to a box end 60 of a wrench for allowing the wrench to be used with a socket 70. Referring to FIGS. 1 through 3, the adaptor in accordance with the present invention generally comprises a body 10, a housing 50, a switch member 30, a pawl 20, and a biasing means 40.

The body 10 comprises a hexagonal first end 11 and a second end. An annular groove 12 is defined in the first end 11 of the body 10 for receiving an O-ring 13. The O-ring 13 protrudes beyond the annular groove 12 so as to engage with an inner periphery defining a box end 61 of a wrench (e.g., a ring spanner 60), as shown in FIGS. 3 and 4. Thus, the hexagonal first end 11 of the body 10 is securely received in the box end 61 of the ring spanner 60.

The body 10 further includes a retainer groove 14 in the second end thereof for receiving a retainer (e.g., a C-clip 15). A transverse groove 16 is defined in an outer periphery of the body 10, a bottom wall 161 defining the transverse groove 16 including a cavity 162 defined therein. A positioning hole 17 extends from the second end of the body 10 through upper and lower walls defining the transverse groove 16. Further, the body 10 includes a stop 18 that is formed above the transverse groove 16 and that has a diameter greater than that of the hexagonal first end 11.

The pawl 20 is mounted in the transverse groove 16 of the body 10 and includes a first toothed side 21 and a second toothed side 22. Further, the pawl 20 includes an end having a V-shaped positioning portion 23. Further, the pawl 20 includes a transverse through-hole 24 and an engaging hole 25. The V-shaped positioning portion 23 includes two positioning sections 231 spaced by a tip 232.

The switch member 30 includes a first end 31 for manual operation by a user and a second end 32 in the form of a hook for securely engaging with the engaging hole 25 of the pawl 20. The switch member 30 further includes a hole 33 adjacent to the second end 32. A pin 34 extends through the positioning hole 17 of the body 10, the through-hole 24 of the pawl 20, and the hole 33 of the switch member 30, thereby pivotally mounting the pawl 20 and the switch member 30 in the transverse groove 16 of the body 10. The pawl 20 is moved when the switch member 30 is pivoted, which will be described in detail later.

The basing means 40 includes an elastic element 41 and a ball 42 that are received in the cavity 162 of the body 10. The ball 42 is biased outward by the elastic element 41 to press against one of the positioning sections 231 of the pawl 20, thereby positioning the pawl 20.

The housing 50 includes a first end in which a compartment 51 is defined and a second end in the form of a driving column 55 for releasably engaging with an engaging hole 71 of a socket 70 (FIG. 4). An inner periphery 52 defining the compartment 51 includes teeth for engaging with one of the toothed sides 21 and 22 of the pawl 20. Further, the compartment 51 includes an enlarged section 52 in a bottom thereof, thereby forming a shoulder 54, as shown in FIG. 3. The second end of the body 10 is mounted in the compartment 51 of the housing 50. The C-clip 15 mounted in the retainer groove 14 of the body 10 protrudes radially outward after assembly of the body 10 and the housing 50. Thus, disengagement of the body 10 from the housing 50 is prevented, as the C-clip 15 is stopped by the shoulder 54 of the housing 50, best shown in FIG. 3. In addition, the body 10 may rotate freely relative to the housing 50.

Referring to FIG. 4, the hexagonal first end 11 of the body 11 is mounted in the box end 61 of the ring spanner 60 with the stop 18 abutting against a side of the box end 61, thereby preventing excessive insertion of the hexagonal first end 11 of the body 11 into the box end 61. Further, the O-ring 13 resiliently abuts against the toothed inner periphery of the box end 61. Next, the drive column 55 of the housing 50 is engaged in the engaging hole 71 of the socket 70.

Figure 5:
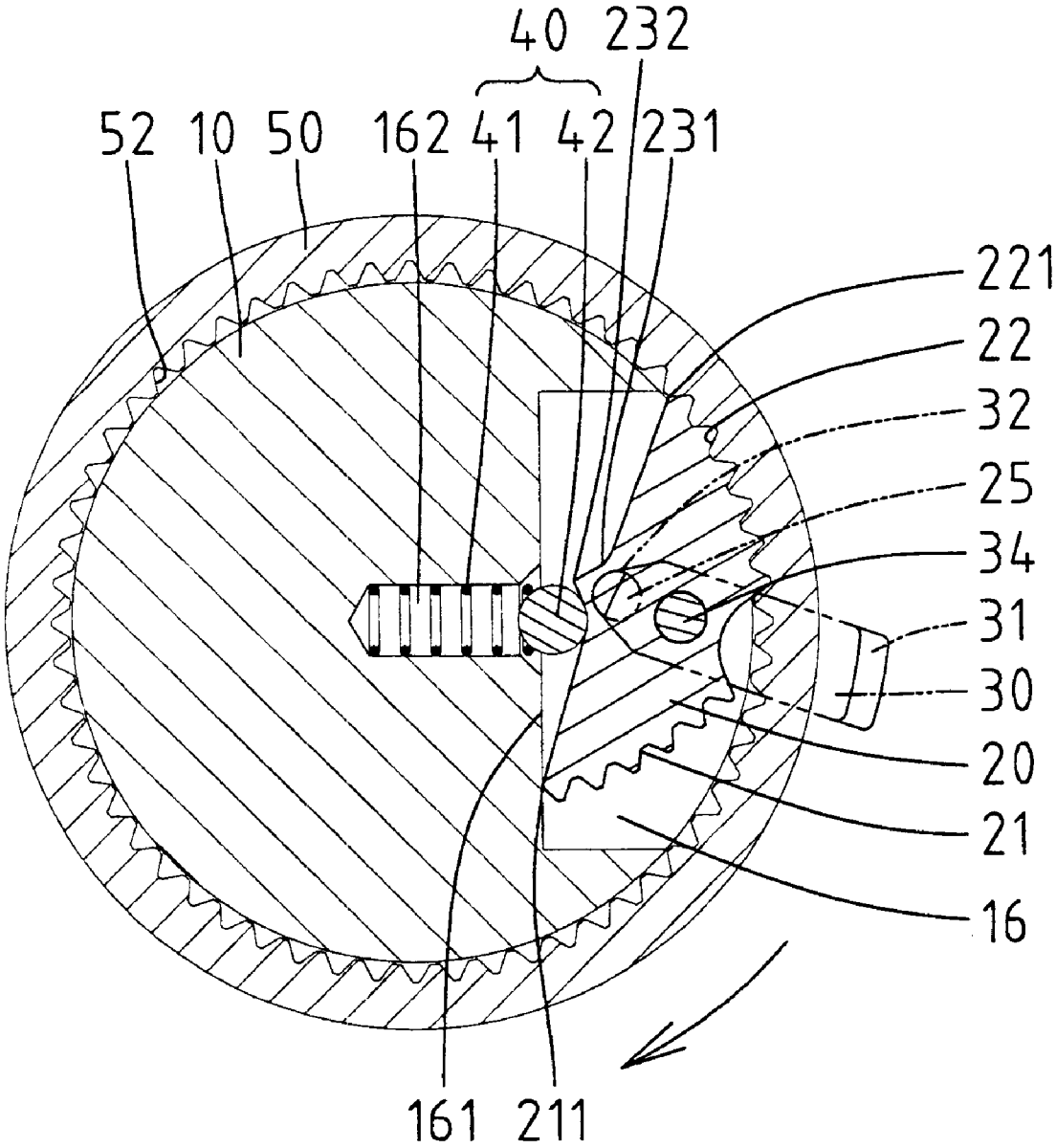
FIG. 5 is a sectional view taken along plane 5—5 in FIG. 3.

When the user intends to drive a fastener (not shown) clockwise, the first end 31 of the switch member 30 is moved to a position shown in FIG. 5. Since the second end 32 of the switch member 30 is engaged with the pawl 20, the pawl 20 pivots until the second toothed side 22 engages with the teeth of the inner periphery 52 of the housing 50 while an end 211 of the first toothed side 21 of the pawl 20 abuts against the bottom wall 161 defining the transverse groove 16. The ball 42 is biased by the elastic element 41 to press against one of the retaining sections 231 of the pawl 20. Thus, when the ring spanner 60 is turned clockwise, the body 10 and the housing 50 are engaged with each other via the pawl 20. As a result, the fastener is driven by the drive column 55 of the housing 50. When the ring spanner 60 is turned counterclockwise, the pawl 20 is not supported such that the second toothed side 22 of the pawl 20 disengages from the teeth of the inner periphery 52 of the housing 50. Namely, the ring spanner 60 turns freely without driving the housing 50 and the fastener. The second toothed side 22 of the pawl 20 returns to its position shown in FIG. 5 under the action of the elastic element 42.

Figure 6:
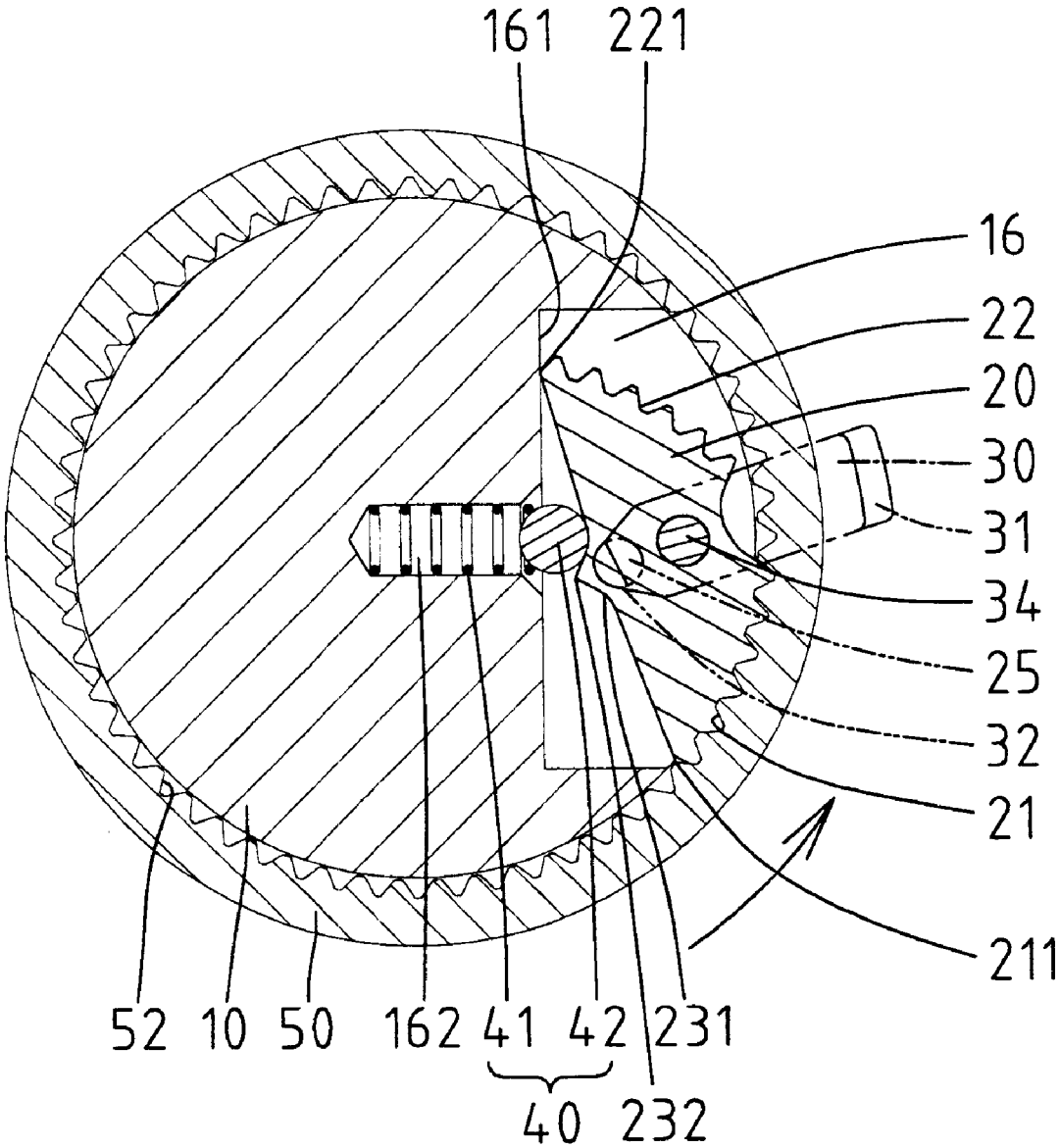
FIG. 6 is a sectional view similar to FIG. 5, illustrating operation of the adaptor in a reverse direction.
Figure 7:
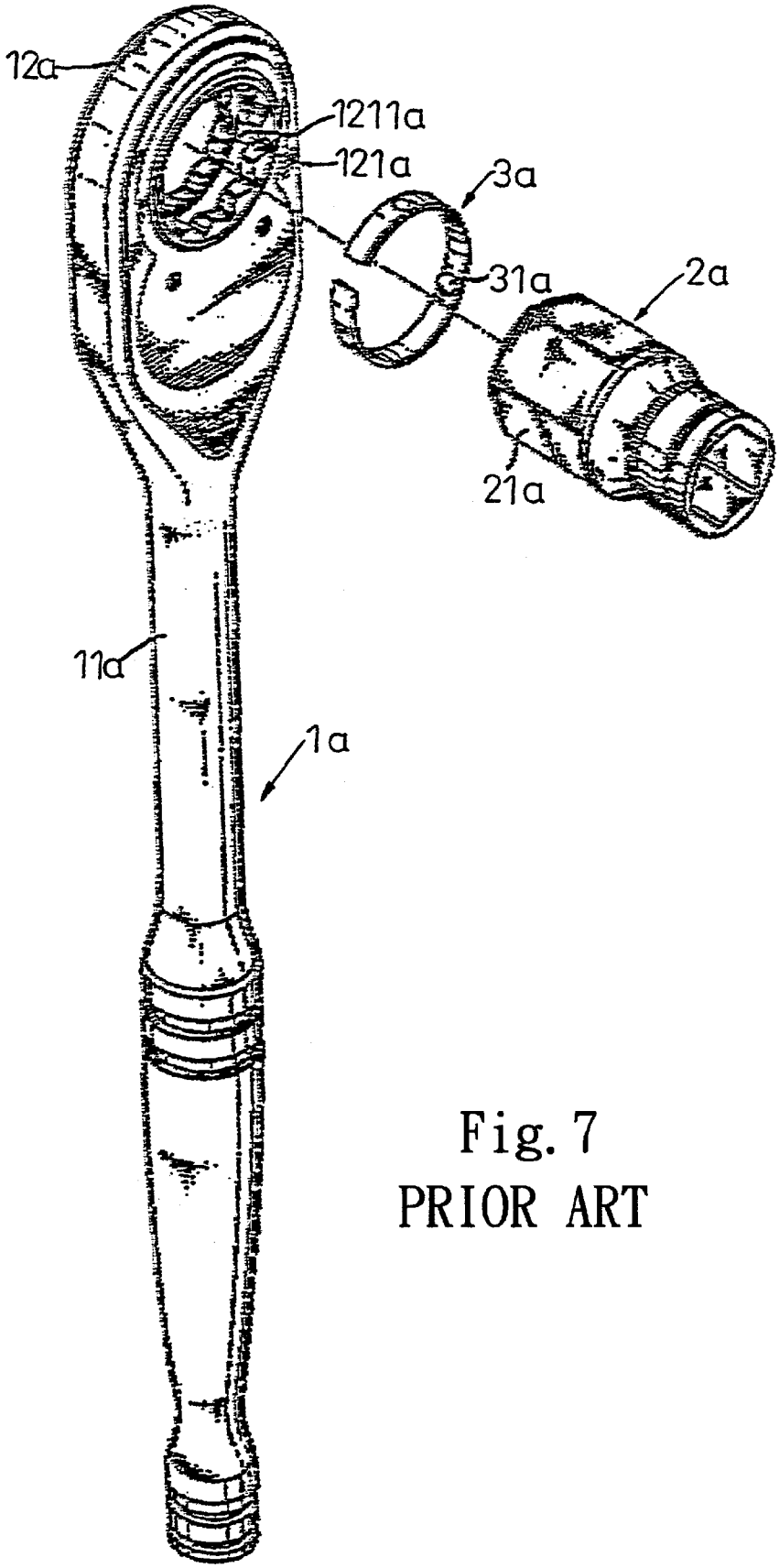
Fig. 7 PRIOR ART
FIG. 7 is an exploded perspective view of a conventional socket wrench and a socket.
Figure 8:
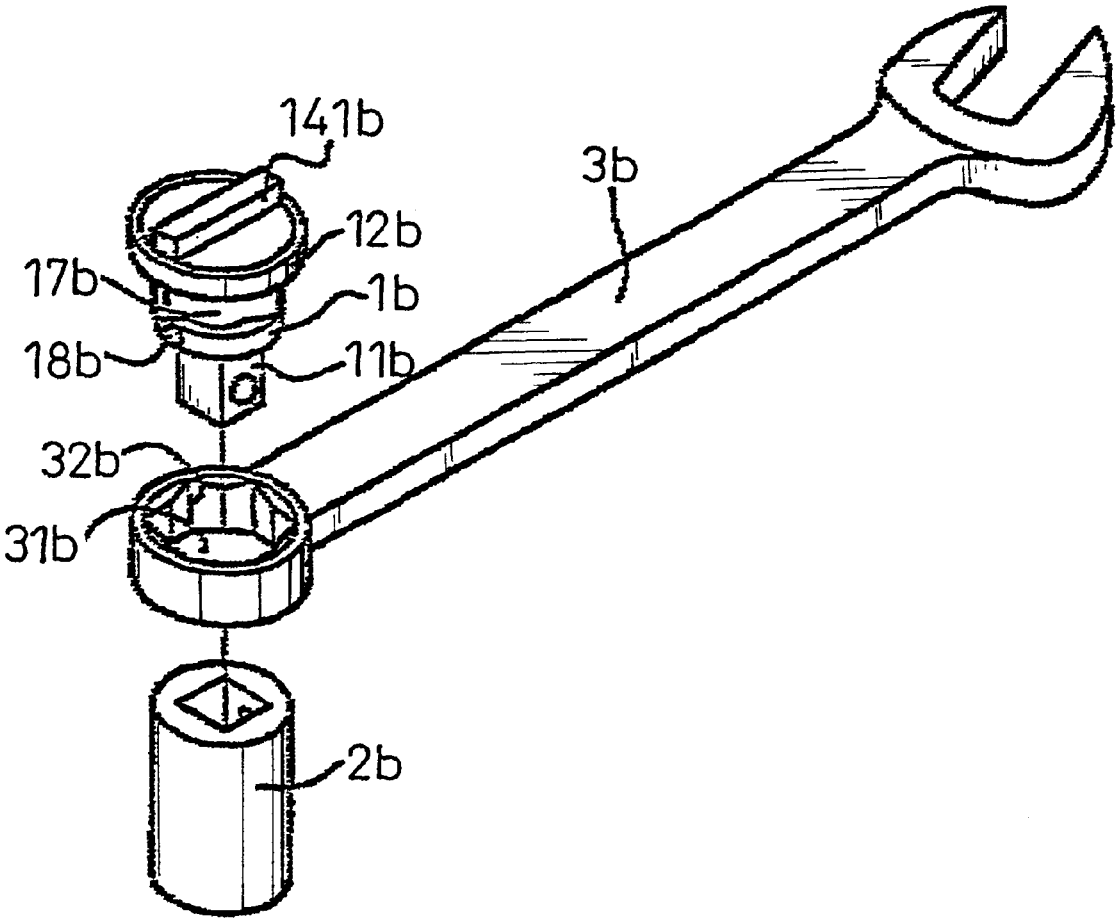
Fig. 8 PRIOR ART
FIG. 8 is an exploded perspective view of a conventional combination wrench, an adaptor, and a socket.

When the user intends to drive the fastener counterclockwise, the first end 31 of the switch member 30 is moved to a position shown in FIG. 6. Since the second end 32 of the switch member 30 is engaged with the pawl 20, the pawl 20 pivots until the first toothed side 21 engages with the teeth of the inner periphery 52 of the housing 50 while an end 221 of the second toothed side 22 of the pawl 20 abuts against the bottom wall 161 defining the transverse groove 16. The ball 42 is biased by the elastic element 41 to press against the other retaining section 231 of the pawl 20. Thus, when the ring spanner 60 is turned counterclockwise, the body 10 and the housing 50 are engaged with each other via the pawl 20. As a result, the fastener is driven by the drive column 55 of the housing 50. When the ring spanner 60 is turned clockwise, the pawl 20 is not supported such that the first toothed side 22 of the pawl 20 disengages from the teeth of the inner periphery 52 of the housing 50. Namely, the ring spanner 60 turns freely without driving the housing 50 and the fastener. The first toothed side 21 of the pawl 20 returns to its position shown in FIG. 6 under the action of the elastic element 42.

According to the above description, it is appreciated that the stop 18 on the body 10 prevents excessive insertion of the first end 11 of the body 10 into the box end 61 of the ring spanner 60. The O-ring 13 resiliently abuts against the inner periphery of the box end 61, thereby securely engaging the body 10 in the box end 61. The switch member 30 can be easily operated with a single hand, allowing reversible operation of the ring spanner 60.

Although the invention has been explained in relation to its preferred embodiment, it is to be understood that many other possible modifications and variations can be made without departing from the scope of the invention as hereinafter claimed.

What is claimed is:

1. An adaptor for engaging with a box end of a wrench for use with a socket, the adaptor comprising:

a housing including a first end and a second end adapted to engage with a socket, the first end of the housing including a compartment defined by a toothed inner periphery;

a body including a first end adapted to be engaged in a box end of a wrench and a second end rotatably received in the compartment of the housing, the body including a transverse groove, a bottom wall defining the transverse groove including a cavity;

a pawl pivotally mounted in the transverse groove and including a first toothed side and a second toothed side selectively engaged with the toothed inner periphery of the housing;

a biasing means mounted in the cavity of the body for biasing the pawl toward the toothed inner periphery of the housing, thereby allowing one of the first toothed side and the second toothed side of the pawl to engage with the toothed inner periphery of the housing; and a switch member including a first end for manual operation and a second end engaged with the pawl, the switch member being pivotable between two positions corresponding to two opposite ratcheting directions to selectively urge an associated one of the first toothed side and the second toothed side of the pawl to engage with the toothed inner periphery of the housing.

2. The adaptor as claimed in claim 1, wherein the first end of the body is hexagonal and includes an annular groove for receiving an O-ring, the O-ring protruding out of the annular groove for engaging with an inner periphery of the box end of the wrench, thereby securely retaining the first end of the body in the box end of the wrench.

3. The adaptor as claimed in claim 2, wherein the body includes a stop above the transverse groove, the stop having a diameter greater than that of the body for abutting against a side of the box end, thereby preventing excessive insertion of the hexagonal first end of the body into the box end of the wrench.

4. The adaptor as claimed in claim 1, wherein the compartment of the housing includes an enlarged section, thereby forming a shoulder, a C-clip being mounted to the second end of the body and resting on the shoulder to thereby prevent disengagement of the body from the housing.

5. The adaptor as claimed in claim 1, wherein the pawl includes an end having two retaining sections spaced by a tip, the biasing means including an elastic element and a ball biased by the elastic element to be selectively engaged with one of the retaining sections of the pawl.

6. The adaptor as claimed in claim 1, wherein the pawl includes an engaging hole, the second end of the switch member includes a hook for securely engaging with the engaging hole of the pawl.

7. The adaptor as claimed in claim 1, wherein the pawl includes a through-hole, the switch member including a hole, further comprising a pin extending through the second end of the body, the through-hole of the pawl, and the hole of the switch member, thereby pivotally mounting the pawl and the switch member in the transverse groove.

* * * * *